US005868321A

United States Patent [19]

Haruch

[11] Patent Number: 5,868,321

[45] Date of Patent: Feb. 9, 1999

[54] ENHANCED EFFICIENCY ATOMIZING AND SPRAY NOZZLE

[75] Inventor: James Haruch, Naperville, Ill.

[73] Assignee: Spraying Systems Co., Wheaton, Ill.

[21] Appl. No.: 371,087

[22] Filed: Jan. 10, 1995

[51] Int. Cl.[6] ..... B05B 7/10

[52] U.S. Cl. ..... 239/399; 239/427; 239/432; 239/492

[58] Field of Search ..... 239/492, 493, 239/432, 434, 427, 399

[56] References Cited

U.S. PATENT DOCUMENTS

| | | | |
|---|---|---|---|
| 1,186,193 | 6/1916 | Hoffman . | |
| 1,535,702 | 4/1925 | Walsh et al. . | |
| 2,080,264 | 5/1937 | Gray | 239/492 X |
| 2,378,348 | 6/1945 | Wilacs et al. | 239/491 |
| 2,984,420 | 5/1961 | Hession | 239/492 |
| 3,147,924 | 9/1964 | Schulze | 239/493 X |
| 3,441,223 | 4/1969 | Lapera | 239/492 X |
| 3,540,658 | 11/1970 | Simmons | 239/492 X |
| 3,929,290 | 12/1975 | Tallorovic . | |
| 4,182,496 | 1/1980 | Burke | 239/497 |
| 4,706,888 | 11/1987 | Dobbs | 239/478 |

FOREIGN PATENT DOCUMENTS

| | | | |
|---|---|---|---|
| 679248 | 8/1979 | U.S.S.R. | 239/492 |
| 742671 | 7/1980 | U.S.S.R. | 239/492 |

*Primary Examiner*—Kevin Weldon
*Attorney, Agent, or Firm*—Leydig, Voit & Mayer, Ltd.

[57] ABSTRACT

A cap is disposed internally of a spray nozzle and effects active atomization of pressurized liquid flowing through the nozzle by mixing with compressed air and creating turbulence in the liquid during the flow. The nozzle includes an internal cap which cap which imparts significant turbulence on the flow through the nozzle serving to help atomize the liquid using a reduced amount of air energy. Different caps may be used to create various selected spray patterns.

8 Claims, 3 Drawing Sheets

ENHANCED EFFICIENCY ATOMIZING AND SPRAY NOZZLE

BACKGROUND OF THE INVENTION

The invention relates to a spray nozzle and, more particularly, to a nozzle for directing a pressurized spray of atomized liquid into the atmosphere in the form of extremely small particles.

Systems for atomizing liquid with a pressurized gas such as air are known. In certain ones of such systems, the liquid is broken up both mechanically and by the pressurized air in an atomizing chamber located upstream of the spray nozzle. The atomized liquid then is ejected from the nozzle through one or more discharge openings in the nozzle.

An often-sought goal in atomizing and spraying apparatus is to achieve high efficiency. High efficiency in the context of the present invention refers to using as little air energy as possible to break liquid of a given volume into particles having a large total surface area. Larger surface areas are, of course, created by breaking the liquid into very fine particles.

A further goal is to provide nozzles having the capability of discharging the liquid in different spray patterns. By way of example, some applications require a narrow angle round spray, other applications may require a wide angle round spray (i.e., a full cone spray) and still other applications may require a flat spray.

In prior atomizing/spraying apparatus, the desired spray pattern is usually generated by forcing the atomized liquid through properly shaped discharge orifice means in the nozzle. A narrow angle round spray, for example, may be created by providing the nozzle with a single round orifice. A wide angle round spray may be generated by a nozzle having a plurality of angularly spaced diverging orifices. An elongated slot or an elliptically shaped orifice in the discharge nozzle produces a substantially flat spray pattern.

Nozzles having discharge orifices of the above type are essentially passive with respect to effecting further atomization of the liquid as the liquid is discharged from the nozzle. Certain nozzles do produce some further atomization during flow of the liquid through the nozzle but, for the most part, the atomization effected by the nozzle has limited impact on the overall efficiency of the atomizing and spraying apparatus.

SUMMARY OF THE INVENTION

The general aim of the present invention is to provide a new and improved nozzle which, when compared to prior nozzles, more actively participates in the atomization process so as to enable the atomizing and spraying apparatus to operate with higher efficiency.

A more detailed object of the invention is to achieve the foregoing by providing a nozzle which is uniquely equipped with an internal cap for breaking up the atomized liquid into still smaller particles as the liquid flows through the nozzle.

In a still more detailed sense, the invention resides in the provision of a cap which imparts significant turbulence to the liquid during flow of the liquid through the nozzle, the turbulence serving to further atomize the liquid.

A further object is to provide atomizing caps which may be used interchangeably with a common nozzle body to create various selected spray patterns.

These and other objects and advantages of the invention will become more apparent from the following detailed description when taken in conjunction with the accompanying drawings.

Figure 1:
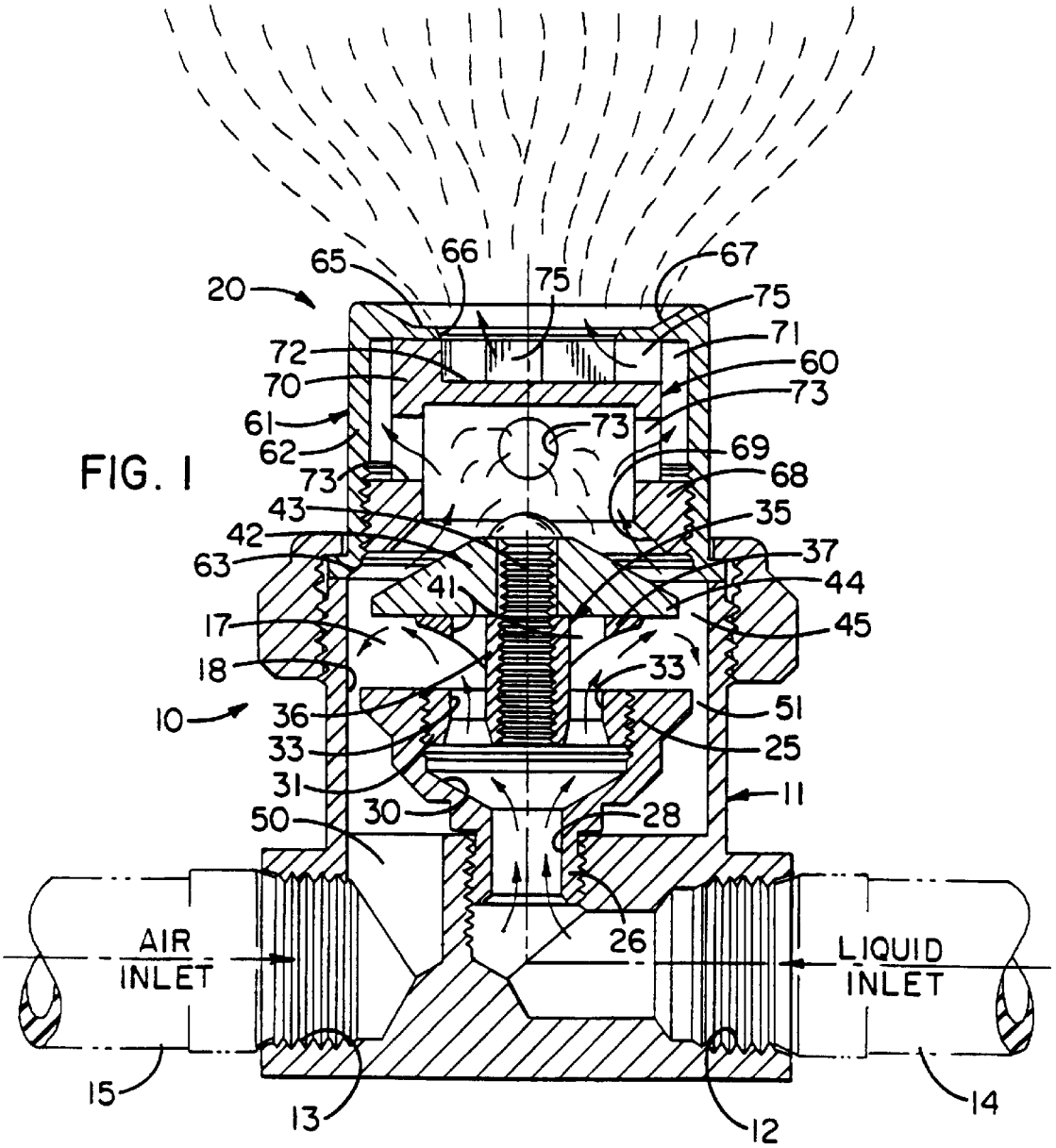
FIG. 1 is a cross-sectional view taken generally axially through one embodiment of atomizing and spraying apparatus having a new and improved nozzle incorporating the unique features of the present invention.
Figure 2:
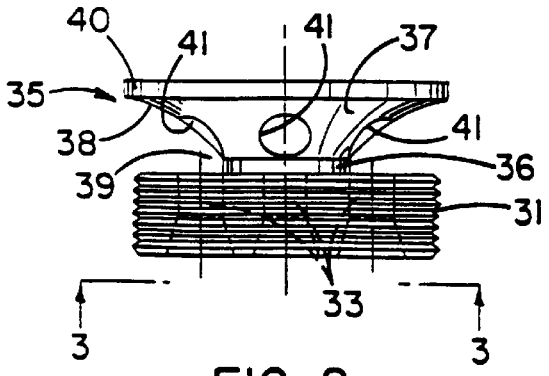
FIG. 2 is a side plan view of deflector plug shown in FIG. 1.
Figure 3:
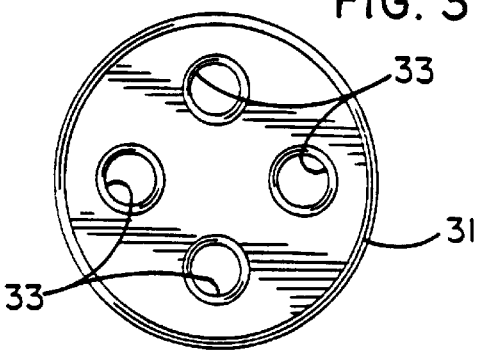
FIG. 3 is a bottom view of the deflector plug taken along line 3—3 of FIG. 2.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

As shown in the drawings for purposes of illustration, the invention is embodied in apparatus 10 for atomizing liquid and for discharging the liquid into atmosphere as a very fine spray. The apparatus may, for example, be used to atomize and spray water in various environments.

The apparatus 10 includes a primary atomizer with a main body 11 having one end formed with threaded inlet ports 12 and 13. Lines 14 and 15 are connected to the ports 12 and 13, respectively, and supply the body with pressurized streams of liquid and gas. The gas stream typically is pressurized air.

Formed within and opening out of the opposite end of the body 11 is a chamber 17. Liquid and air are introduced into the chamber from the ports 14 and 15, the liquid is atomized and then is propelled out of the chamber in the form of a fine spray for discharge through a nozzle 20. The latter is located in abutting engagement with the end of the body 11 and is clamped thereto by a collar 21 which is threaded onto the body.

Means are provided in the chamber 17 for mechanically disintegrating the liquid stream into extremely fine particles so that only relatively low air energy is required to effect final atomization of the liquid. Herein, these means include a mounting insert 25 located in the chamber 17 and formed with an externally threaded neck 26 which is screwed into the body 11. The insert is formed with an axially extending passage 28 which communicates with the liquid inlet port 12. Downstream of the passage 28, the insert is formed with a generally frustoconical expansion chamber 30.

The downstream end of the expansion chamber 30 is closed by a plug 31 which divides the liquid stream flowing through the passage 28 into a plurality of angularly spaced jets, the plug being screwed into a tapped bore formed in the mounting insert 25 just downstream of the expansion chamber 30. Four angularly spaced holes or orifices 33 are formed through the plug 31 and establish communication between the expansion chamber 30 and the main chamber 17.

The plug 31 forms an integral part of a larger component 35 which includes a center post 36 extending downstream from the plug and located inwardly of the orifices 33. Also forming an integral part of the component 35 is a deflector 37 which is spaced downstream from the downstream end of the plug. The deflector includes a concavely curved surface which faces the plug and which progresses radially outwardly upon proceeding axially away from the plug. The extreme outer periphery of the curved deflecting surface merges into a cylindrical portion which defines the extreme downstream end of the component 35.

Axially extending and generally cylindrical holes 41 are formed through the deflector 37 and are aligned with the orifices 33 in the plug 31. A plate 42 is secured to the downstream end of the component 35 and closes off the downstream ends of the holes 41. The plate 42 is clamped to the component 35 by a screw 43 extending through a hole in the plate and threaded into a hole in the post 36.

The plate 42 includes a peripheral edge portion 44 which extends radially outwardly beyond the outer periphery of the cylindrical portion of the deflector 37. The plate is circular in cross-section and its outer peripheral edge is spaced radially inwardly from the wall of the chamber 17 so that an annular gap 45 is defined between the plate and the wall. The downstream end of the plate is generally frustoconical and tapers in a downstream direction.

With the foregoing arrangement, a pressurized stream of liquid supplied through the line 14 flows into the expansion chamber 30 via the port 12 and the passage 28. Upon encountering the upstream end of the plug 31, the single stream is broken into four angularly spaced streams or jets which are discharged through the orifices 33. Most of the liquid in the jets shoots into the holes 41, strikes the plate 42 and bounces back toward the downstream end of the plug. Such liquid is propelled outwardly along the deflector 37 by the jets being discharged through the orifices 33 and, as an incident thereto, is spread into a thin and very turbulent sheet. Upon leaving the deflector, the thin sheet of liquid impinges against the peripheral edge portion 44 of the plate 42 and is shattered into fine droplets which flow through the gap 45 between the plate and the wall of the chamber 17.

The pressurized stream of air from the supply line 15 is formed into an annular curtain which cross shears the droplets proceeding toward the gap 45 in order to further atomize the droplets. For this purpose, the port 13 communicates with the chamber 17 by means of an axially extending passage 50 formed in the body 11 and opening into the chamber. As the air flows downstream, it passes through a relatively narrow gap 51 between the wall of the chamber 17 and the outer periphery of the mounting insert 25 and is formed into a high velocity annular curtain. Upon proceeding downstream toward the gap 45, the curtain impacts against and shears through the liquid particles shattered by the peripheral edge portion 44 of the plate 42. Because those particles are in the form of a thin sheet at the time they are impacted by the air, relatively low energy is required to break the particles into still finer particles having a high surface area.

As described thus far, the apparatus is generally similar to that disclosed in my copending U.S. application Ser. No. 08/371,086, filed Jan. 10, 1995, and entitled Enhanced Efficiency Apparatus For Atomizing And Spraying Liquid (Attorney Docket No. 62351). Reference may be made to that application for a more detailed disclosure of the primary atomizing apparatus.

In accordance with the present invention, the nozzle 20 is equipped with a unique cap 60 which effects substantial further atomization of the atomized liquid after the liquid flows past the plate 42. As a result of the atomization produced by the cap, the overall efficiency of the apparatus 10 is increased. Moreover, different caps may be used to produce different spray patterns.

As shown in FIG. 1, the cap 60 is located internally of the nozzle 20. Herein, the nozzle includes a main body 61 made of metal or plastic and having an annular side wall 62. A radially outwardly projecting flange 63 on the lower or upstream end of the side wall is adapted to be clamped against the end of the body 11 by the collar 21. An annular flange 65 is formed integrally with and projects radially inwardly from the downstream end of the side wall 62. The inner edge of the flange 65 defines a circular discharge opening 66 in the nozzle. In this particular instance, the downstream side of the flange 65 includes a frustoconical recess 67 located radially outwardly of the discharge opening and defining a diverging exit at the nozzle.

The atomizing cap 60 also is made of metal or plastic and includes a lower plug portion 68 which is threaded into the open upstream end portion of the nozzle body 61. A centrally located bore 69 which tapers in a downstream direction is formed in the plug and defines an axially extending inlet which communicates with the chamber 17. The upstream end portion of the inlet bore 69 encircles the downstream end portion of the plate 42.

The cap 60 further includes an annular side wall 70 formed integrally with the downstream end portion of the plug 68 and spaced radially inwardly from the side wall 62 of the nozzle body 61. The side wall 62 defines a first internal mixing chamber 80, and as a result of the spacing between the side wall 62 and the nozzle body 61 an annular chamber 71 is defined between the side walls 62 and 70.

In carrying out the invention, an axially facing and radially extending intermediate wall 72 is formed integrally with and is disposed perpendicular to the side wall 70 between the ends thereof and is located in axially spaced opposing relation with the inlet 69. Atomized liquid flowing through the inlet impinges against the wall 72 and then flows to the annular chamber 71. For this purpose, angularly spaced passages 73 are formed through the side wall 70 upstream of the intermediate wall 72. Herein, the passages have been shown as being four angularly spaced and radially extending circular holes. It should be appreciated, however, that two or more circumferentially elongated slots could be formed through the side wall 70 to serve as the passages 73.

After flowing radially outwardly into the chamber 71 through the passages 73, the liquid proceeds a short distance axially of the chamber and then flows radially inwardly from the chamber to the discharge opening 66 of the nozzle body 61. For this purpose, angularly spaced passages 75 are formed in the side wall 70 of the cap 60 downstream of the intermediate wall 72. The cap side wall 70 in this instance defines a second annular mixing chamber 81 which communicates with the body discharge opening 66. The second annular mixing chamber 81 is about the same diameter as the discharge opening 66 such that atomized liquid within the second mixing chamber 81 may proceed through the discharge opening 66 without substantial radial restriction. In the embodiment shown in FIGS. 1, 4A and 4B, there are four equally spaced downstream passages 75 with each passage being oriented so as to lie along a radius of the cap. While the passages 75 could be in the form of circular ports or holes formed through the side wall 70, they preferably are in the form of axially opening slots which are created by milling the downstream end of the side wall with a slotting cutter or the like. When the cap 60 is threaded fully into the nozzle body 61, the downstream end of the side wall 70 abuts the flange 65, and that flange closes off the downstream ends of the slots 75.

With the foregoing arrangement, turbulence is created in the atomized liquid as the liquid flows through the inlet 69 and impinges against the intermediate wall 72 and as the liquid flows through the passages 73 and into the chamber 71. Additional turbulence is generated as the liquid flows out of the chamber 71 and toward the discharge opening 66 through the restricted passages 75. As the four jets of atomized liquid emerging from the passages 75 strike one another, the resulting turbulence effects further break up of the liquid into still smaller particles.

Figure 4A:
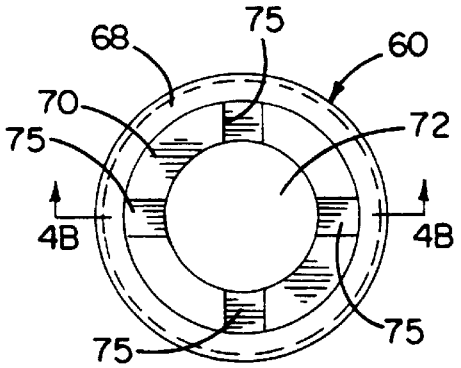
FIG. 4A is a top plan view of the nozzle cap shown in FIG. 1.
Figure 4B:
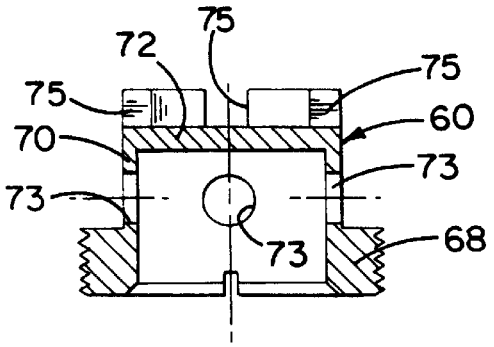
FIG. 4B is a cross-section taken along the line 4B—4B of FIG. 4A.
Figure 5A:
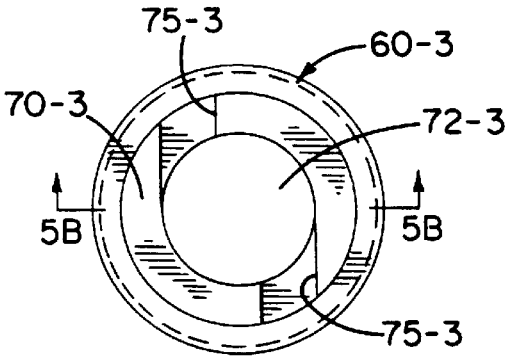
FIGS. 5A, 6A, 7A and 8A are views similar to FIG. 4A but show four alternative embodiments of the nozzle cap.
Figure 5B:
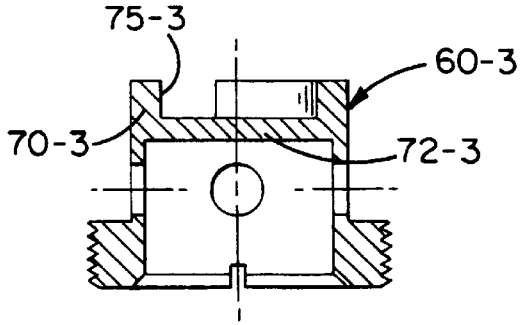
FIG. 5B is a cross-section taken along the line 5B—5B of FIG. 5A.

Because of the equal spacing and radial orientation of the passages 75, the cap 60 of the nozzle of FIGS. 1, 4A and 4B causes the spray to be discharged from the opening 66 in a narrow angle round pattern. By using a cap 60-3 of the type shown in FIGS. 5A and 5B, a flat spray pattern can be created. In the cap 60-3, two equally spaced passages 75-3 are formed tangentially through the side wall 70-3 downstream of the intermediate wall 72-3. As the atomized jets flow through the passages, swirling occurs to produce turbulence and further atomization. The positioning of the passages 75-3 causes the spray to be discharged from the opening 66 in a substantially flat pattern.

Figure 6A:
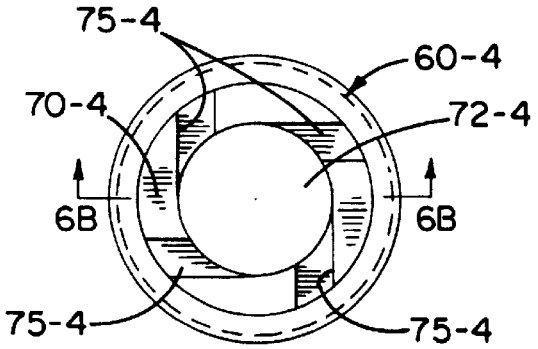
Figure 6B:
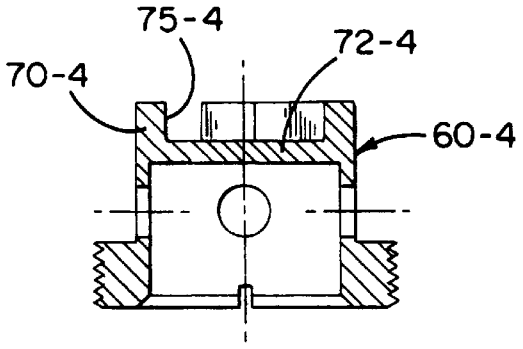
FIG. 6B is a cross-section taken along the line 6B—6B of FIG. 6A.
Figure 7A:
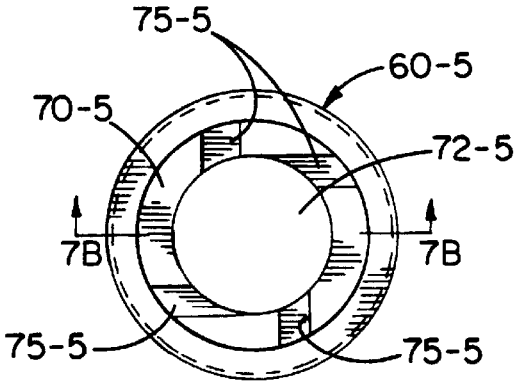
Figure 7B:
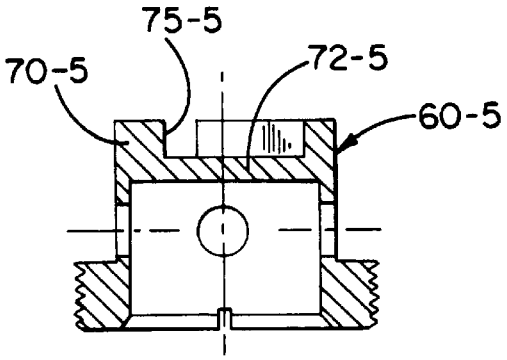
FIG. 7B is a cross-section taken along the line 7B—7B of FIG. 7A.

In the cap 60-4 of FIGS. 6A and 6B, four equally spaced passages 75-4 extend tangentially through the side wall 70-4 downstream of the intermediate wall 72-4. This arrangement creates a square spray pattern. A rectangular pattern may be created with the cap 60-5 of FIGS. 7A and 7B in which four passages 75-5 extend tangentially through the side wall 70-5 downstream of the intermediate wall 72-5. In this case, however, the passages are arranged in two equally spaced pairs and are located such that one passage of each pair is spaced nearer to the other passage of that pair than to the adjacent passage of the other pair.

Figure 8A:
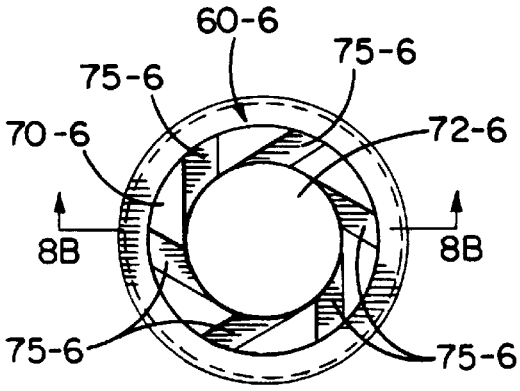
Figure 8B:
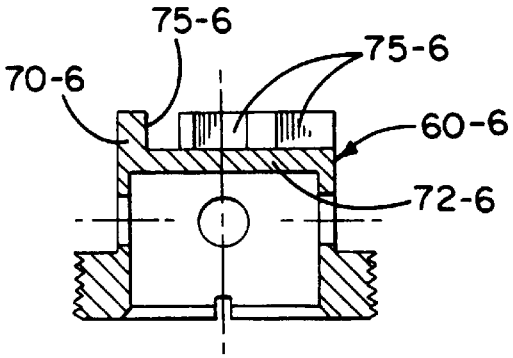
FIG. 8B is a cross-section taken along the line 8B—8B of FIG. 8A.

In the cap 60-6 of FIGS. 8A and 8B, six or more equally spaced passages 75-6 extend tangentially through the side wall 70-6 downstream of the intermediate wall 72-6. This arrangement produces a wide angle round spray (i.e., a full cone spray). As the atomized liquid flows through the passages, the liquid swirls and expands into a rotating full cone pattern which is relatively uniform in distribution when compared to a conventional wide angle round spray nozzle. Moreover, the cap 60-6 is capable of creating spray angles much greater than a conventional nozzle and ranging up to approximately 120 degrees.

From the foregoing, it will be apparent that the present invention brings to the art a new and improved nozzle 20 having an active internal cap 60 which not only contributes significantly to atomization of the liquid but which also can be designed to produce different spray patterns while using the same nozzle body. Those familiar with the art will appreciate that the nozzle can be used with pre-atomizing apparatus other than the specific apparatus which has been shown. Indeed, in certain applications where extremely fine atomization is not required, the atomization may be effected by the nozzle alone and without need of providing pre-atomizing apparatus upstream of the nozzle.

I claim:

1. A nozzle for atomizing and spraying pressurized liquid into the atmosphere comprising a body having an annular side wall, an open upstream end and a downstream end, a discharge opening in the downstream end of said body, an atomizing cap disposed in said body and having an inlet located adjacent the upstream end of said body, said cap having an annular side wall spaced radially inwardly from the side wall of said body for defining an annular chamber between said side walls, said cap having an axially facing intermediate wall perpendicular to said side wall and spaced downstream of said inlet and upstream of said discharge opening for defining a cylindrical chamber on a downstream side of said intermediate wall, said discharge opening being sized sufficiently large in relation to the diameter of said cylindrical chamber that pre-atomized liquid in said cylindrical chamber may proceed through said discharge opening with substantial radial restriction, a first set of circumferentially spaced passages formed through the side wall of said cap upstream of said intermediate wall for conducting liquid from said inlet to said annular chamber, a second set of circumferentially spaced passages formed through said side wall of said cap downstream of said intermediate wall for conducting liquid from said annular chamber to said cylindrical chamber and discharge opening, said second set of passages including at least five equally spaced passages extending tangentially of said cap whereby liquid is caused to flow outwardly as circumferentially spaced jets from said inlet to said chamber, to flow axially downstream of said annular chamber, and then to flow inwardly as circumferentially spaced jets from said annular chamber to said cylindrical chamber and discharge opening for producing a wide angle spray pattern.

2. A spray nozzle assembly comprising a body having a liquid inlet through which a pressurized liquid stream is introduced from a pressurized liquid source and an air inlet through which a pressurized air stream is introduced from a pressurized air source, a mixing chamber in said body within which said pressurized liquid and air streams are intermixed and said liquid is pre-atomized into liquid droplets, said body having an annular side wall and a downstream end formed with a discharge opening, an atomizing cap disposed in said body and having an upstream inlet for receiving said pre-atomized liquid, said cap having an annular side wall spaced radially inwardly from the side wall of said body for defining an annular chamber between said side walls, said cap having an axially facing intermediate wall spaced downstream of said inlet and upstream of said discharge opening, said intermediate wall extending generally perpendicular to the side wall of said cap, a first set of circumferentially spaced passages formed through the side wall of said cap upstream of said intermediate wall for conducting pre-atomized liquid from said inlet to said chamber, a second set of circumferentially spaced passages formed through said side wall of said cap downstream of said intermediate wall for conducting pre-atomized liquid from said chamber to said discharge opening, said second set of passages consisting of four equally spaced passages located along radii of said cap whereby said pre-atomized liquid is caused to flow outwardly as circumferentially spaced jets from said inlet to said chamber, to flow axially downstream of said chamber, and to then flow inwardly from said four equally spaced passages as circumferentially spaced jets from said chamber to said discharge opening for producing a narrow angled and substantially round spray pattern.

3. A spray nozzle assembly comprising a body having a liquid inlet through which a pressurized liquid stream is introduced from a pressurized liquid source and an air inlet through which a pressurized air stream is introduced from a pressurized air source, a mixing chamber in said body within which said pressurized liquid and air streams are intermixed and said liquid is pre-atomized into liquid droplets, said body having an annular side wall and a downstream end formed with a discharge opening, an atomizing cap disposed in said body and having an upstream inlet for receiving said pre-atomized liquid, a downstream end formed with a discharge opening, an atomizing cap disposed in said body and having an inlet located adjacent an upstream end thereof, said cap having an annular side wall spaced radially inwardly from the side wall of said body for defining an annular chamber between said side walls, said cap having an axially facing intermediate wall perpendicular to said side wall spaced downstream of said inlet and upstream of said discharge opening for defining a cylindrical chamber on a downstream side of said intermediate wall, said discharge opening being sized sufficiently large in relation to the diameter of said cylindrical chamber that pre-atomized liquid in said cylindrical chamber may proceed through said discharge opening with substantial radial restriction, a first set of circumferentially spaced passages formed through the side wall of said cap upstream of said intermediate wall for conducting pre-atomized liquid from said inlet to said annular chamber, a second set of circumferentially spaced passages formed through said side wall of said cap downstream of said intermediate wall for conducting pre-atomized liquid from said annular chamber to said cylindrical chamber and discharge opening, said second set of passages consisting of only two passages extending tangentially of said cap circumferentially spaced 180° apart from each other whereby said pre-atomized liquid is caused to flow outwardly as circumferentially spaced jets from said inlet to said annular chamber, to flow axially downstream of said annular chamber, and to then flow inwardly as circumferentially spaced jets from said annular chamber to said cylindrical chamber and discharge opening for producing a substantially flat spray pattern.

4. A spray nozzle assembly comprising a body having a liquid inlet through which a pressurized liquid stream is introduced and an air inlet through which a pressurized air stream is introduced, a mixing chamber in said body within which said pressurized liquid and air streams are intermixed and said liquid is pre-atomized into liquid droplets, said body having an annular side wall and a downstream end formed with a discharge opening, an atomizing cap disposed in said body and having an upstream inlet for receiving said pre-atomized liquid, a downstream end formed with a discharge opening, an atomizing cap disposed in said body and having an inlet located adjacent an upstream end thereof, said cap having an annular side wall spaced radially inwardly from the side wall of said body for defining an annular chamber between said side walls, said cap having an axially facing intermediate wall spaced downstream of said inlet and upstream of said discharge opening, said intermediate wall extending generally perpendicular to the side wall of said cap, a first set of circumferentially spaced passages formed through the side wall of said cap upstream of said intermediate wall for conducting pre-atomized liquid from said inlet to said chamber, a second set of circumferentially spaced passages formed through said side wall of said cap downstream of said intermediate wall for conducting pre-atomized liquid from said chamber to said discharge opening, said second set of passages consisting of two sets of equally spaced passages extending tangentially of said cap whereby said pre-atomized liquid is caused to flow outwardly as circumferentially spaced jets from said inlet to said chamber, to flow axially downstream of said chamber, and to then flow inwardly as circumferentially spaced jets from said chamber to said discharge opening for producing a substantially square spray pattern.

5. A spray nozzle assembly comprising a body having a liquid inlet through which a pressurized liquid stream is introduced and an air inlet through which a pressurized air stream is introduced, a mixing chamber in said body within which said pressurized liquid and air streams are intermixed and said liquid is pre-atomized into liquid droplets, said body having an annular side wall and a downstream end formed with a discharge opening, an atomizing cap disposed in said body and having an upstream inlet for receiving said pre-atomized liquid, a downstream end formed with a discharge opening, an atomizing cap disposed in said body and having an inlet located adjacent an upstream end thereof, said cap having an annular side wall spaced radially inwardly from the side wall of said body for defining an annular chamber between said side walls, said cap having an axially facing intermediate wall spaced downstream of said inlet and upstream of said discharge opening, said intermediate wall extending generally perpendicular to the side wall of said cap, a first set of circumferentially spaced passages formed through the side wall of said cap upstream of said intermediate wall for conducting pre-atomized liquid from said inlet to said chamber, a second set of circumferentially spaced passages formed through said side wall of said cap downstream of said intermediate wall for conducting pre-atomized liquid from said chamber to said discharge opening, said second set of passages consisting of first, second, third and fourth passages extending tangentially of said cap, said first and third passages being spaced 180 degrees from one another, said second and fourth passages being spaced 180 degrees from one another, the spacing between said first passages and said second passages being less than the spacing between said second passage and said third passage whereby said pre-atomized liquid is caused to flow outwardly as circumferentially spaced jets from said inlet to said chamber, to flow axially downstream of said chamber, and to then flow inwardly as circumferentially spaced jets from said chamber to said discharge opening for producing a substantially rectangular spray pattern.

6. A nozzle for atomizing and spraying pressurized liquid into the atmosphere comprising a body having an annular side wall, an open upstream end and a downstream end, the downstream end of said body being defined by an annular flange projecting generally radially inwardly from said side wall, said flange having an inner edge defining a centrally located discharge opening in said body, an atomizing cap located in said body, said cap having an annular side wall and an axially facing intermediate wall, said intermediate wall being spaced downstream from said inlet and being spaced upstream from said discharge opening, said cap side wall defining a first cylindrical mixing chamber having an open upstream end for receiving said pre-atomized liquid, said cap defining a second cylindrical mixing chamber downstream of said intermediate wall smaller in diameter than said first chamber, said second annular chamber communicating with said discharge orifice, said discharge opening being sized sufficiently large in relation to the diameter of said second annular chamber that pre-atomized liquid in said second annular chamber may proceed through said discharge orifice without substantial radial restriction, said cap side wall being spaced radially inwardly from the side wall of said body for defining an annular chamber between said side walls, a first set of circumferentially spaced passages formed through said side wall of said cap upstream of said intermediate wall whereby pre-atomized liquid flowing into said first mixing chamber impinges against said intermediate wall and flows into said annular chamber via the passages of said first set, and a second set of circumferentially spaced passages extending through said side wall of said cap downstream of said intermediate wall communicating between said annular chamber and said second cylindrical mixing chamber whereby liquid in said annular chamber flows through said second set of passages into said second mixing chamber and then out of said nozzle via said discharge opening in a spray pattern determined by the arrangement of said second set of passages.

7. A nozzle as defined in claim 6 in which said discharge opening is about the same diameter as said second mixing chamber.

8. A nozzle for atomizing and spraying pressurized liquid into the atmosphere comprising a body having an annular side wall, an open upstream end and a downstream end, the downstream end of said body being defined by an annular flange projecting generally radially inwardly from said side wall, said flange having an inner edge defining a centrally located discharge opening in said body, an atomizing cap located in said body, said cap having an annular side wall and an axially facing intermediate wall, said intermediate wall being spaced downstream from said inlet and being spaced upstream from said discharge opening, said cap side wall defining a cylindrical mixing chamber having an open upstream end for receiving said pre-atomized liquid, said cap defining a second cylindrical mixing chamber downstream of said intermediate wall, said second cylindrical mixing chamber communicating with said discharge orifice, said discharge opening being sized sufficiently large in relation to the diameter of said second annular chamber that pre-atomized liquid in said second annular chamber may proceed through said discharge orifice without substantial radial restriction, said cap side wall being spaced radially inwardly from the side wall of said body for defining an annular chamber between said side walls, a first set of circumferentially spaced passages formed through said side wall of said cap upstream of said intermediate wall whereby pre-atomized liquid flowing into said mixing chamber impinges against said intermediate wall and flows into said annular chamber via the passages of said first set, and a second set of circumferentially spaced passages downstream of said intermediate wall including axially open holes in said side wall and with said body flange being disposed in abutting relation to an axial end of said cap side wall for closing the downstream ends of said holes whereby liquid in said annular chamber flows through said second set of passages and then out of said nozzle via said second cylindrical mixing chamber and discharge opening in a spray pattern determined by the arrangement of said second set of circumferentially spaced passages.

* * * * *